US008425252B2

(12) United States Patent
Cai

(10) Patent No.: US 8,425,252 B2
(45) Date of Patent: Apr. 23, 2013

(54) ELECTRICAL CONNECTOR

(75) Inventor: You Hua Cai, Guangzhou (CN)

(73) Assignee: Lotes Co., Ltd., Keelung (TW)

( * ) Notice: Subject to any disclaimer, the term of this patent is extended or adjusted under 35 U.S.C. 154(b) by 71 days.

(21) Appl. No.: 13/293,895

(22) Filed: Nov. 10, 2011

(65) Prior Publication Data

US 2013/0040498 A1 Feb. 14, 2013

(30) Foreign Application Priority Data

Aug. 12, 2011 (CN) ..... 2011 2 0291555 U

(51) Int. Cl.
*H01R 13/60* (2006.01)

(52) U.S. Cl.
USPC ..... 439/541.5; 439/637

(58) Field of Classification Search ..... 439/541.5, 439/540.1, 79, 626, 636, 637, 108, 358, 631, 439/733.1, 869, 872, 873, 260, 495, 83, 64, 439/607.23, 607.24, 607.32, 607.34, 607.1–607.12, 439/676, 928
See application file for complete search history.

(56) References Cited

U.S. PATENT DOCUMENTS

| | | | | |
|---|---|---|---|---|
| 6,116,957 | A * | 9/2000 | Mickievicz et al. | 439/631 |
| 6,176,737 | B1 * | 1/2001 | Choy | 439/541.5 |
| 6,699,068 | B2 * | 3/2004 | Wu | 439/541.5 |
| 7,938,651 | B2 * | 5/2011 | Hanyu et al. | 439/79 |
| 8,182,283 | B2 * | 5/2012 | Chang | 439/541.5 |

* cited by examiner

*Primary Examiner* — Renee Luebke
*Assistant Examiner* — Harshad Patel
(74) *Attorney, Agent, or Firm* — Morris Manning & Martin LLP; Tim Tingkang Xia, Esq.

(57) ABSTRACT

The present invention relates to an electrical connector. The electrical connector includes an insulating body having a plurality of card slots recessed at a front end. The insulating body has adjacent a plurality of first and second receiving slots disposed at a rear end of the card slots. Each of a plurality of first terminals has a first connecting portion received in the first receiving slot. Each of a plurality of second terminals has a second connecting portion received in the first receiving slot. The second terminal has an extending portion extending laterally, entering the first receiving slot, and disposing in a front-rear manner relative to a corresponding part of the first terminal. The insulating body has a gap defined between the extending portion and an adjacent extending portion.

10 Claims, 8 Drawing Sheets

ELECTRICAL CONNECTOR

CROSS-REFERENCE TO RELATED APPLICATION

This application claims priority of Chinese Patent Application No. 201120291555.8, filed on Aug. 12, 2011, entitled "Electrical Connector", by You Hua Cai, the disclosure of which is incorporated herein by reference in its entirety.

FIELD OF THE INVENTION

The present invention relates to an electrical connector, and more particularly to an electrical connector for electrically connecting two electronic cards to a circuit board.

BACKGROUND OF THE INVENTION

With the increasing diversity of functions of consumer electronic products such as notebook computers, while the volume and space of the current notebook computers are limited, in order to effectively utilize the space resource, various stacked card edge connectors are developed, for example, upper-lower stacked type and front-rear stacked type. A stacked electrical connector, for fixing and electrically connecting two electronic cards to a circuit board, mainly includes an insulating body and multiple conductive terminals retained in the insulating body, in which an upper card slot and a lower card slot are disposed on the insulating body for receiving a front edge of one of the electronic card respectively, and multiple terminal receiving slots are disposed above and below the upper card slot and the lower card slot for receiving the multiple conductive terminals.

However, when the upper card slot and the lower card slot of the insulating body match one of the electronic cards respectively, in order to electrically connect the two electronic cards to the circuit board, multiple conductive terminals needs to be disposed in multiple rows for conducting each of the electronic cards, and multiple receiving slots of a corresponding number need to be formed and opened at the rear end of the insulating body corresponding to each of the conductive terminals, for inserting the conductive terminal. As compared with a conventional card edge connector for inserting one of the electronic cards, the number of the conductive terminals arranged in the insulating body is greatly increased, so that the space for extension of the wall of the receiving slot at the rear end of the insulating body is approximately reduced by a half. Since the distance between adjacent conductive terminals is too small, the wall of the receiving slots cannot be disposed. Even if the wall of the receiving slot is disposed with difficulty, the wall of the receiving slot gets too thin, thereby influencing the mechanical performance and the electrical performance of the insulating body. Broken or damage of the insulating body easily occurs due to the thin wall of the receiving slot, so the production efficiency is low, and quality requirements of the product cannot be met.

Therefore, a heretofore unaddressed need exists in the art to design a novel electrical connector to address the aforementioned deficiencies and inadequacies.

SUMMARY OF THE INVENTION

In view of the above problems in the prior art, the present invention is directed to an electrical connector, which has an increased distance between terminals, so as to provide sufficient space for disposing a wall of a receiving slot at a rear end of the insulating body, or has an increased wall thickness, so as to improve the mechanical performance and the electrical performance of the insulating body.

To achieve the above objectives, the present invention adopts the following technical solution.

An electrical connector is provided, which includes an insulating body, having at least one card slot recessed at a front end thereof, a plurality of adjacent first receiving slots and second receiving slots disposed at a rear end of the insulating body. The first receiving slot extends forwards to form a first guide slot, the second receiving slot extends forwards to form a second guide slot. The first and the second guide slot are in communication with the card slot respectively. A plurality of first terminals received in the first receiving slots. Each of the first terminals has a first connecting portion received in the first receiving slot, and the first connecting portion extends forwards to form a first contacting portion passing through the first guide slot and exposed in the card slot. A plurality of second terminals received in the second receiving slots. Each of the second terminals has a second connecting portion, and the second connecting portion extends forwards to form a second contacting portion exposed in the card slot. The second terminal has an extending portion extends laterally, and the extending portion enters the first receiving slot and disposed in a front-rear manner with a corresponding part of the first terminal. The insulating body has a gap defined between the extending portion and an adjacent extending portion.

Further, the electrical connector includes a plurality of third terminals. Each of the third terminal has a third connection portion received in the first receiving slot. The third connection portion of the third terminal is disposed in a front-rear manner with the extending portion of the second terminal.

Additionally, the third connection portion of the third terminal extends forwards to form a third contacting portion passing through the first guide slot and exposed in the corresponding card slot.

Furthermore, the electrical connector includes a plurality of fourth terminals. Each of the fourth terminals is inserted from the front end of the insulating body. A fourth contacting portion is exposed in the corresponding card slot.

An electrical connector is provided, which includes an insulating body, having two card slots recessed at a front end thereof. The two card slots are arranged in an upper-lower manner. The insulating body has a plurality of adjacent first receiving slots and second receiving slots disposed at a rear end of the insulating body. The first receiving slot and the second receiving slot extend forwards respectively to form a first guide slot and a second guide slot arranged in an upper-lower manner. Each of the card slots is in communication with the first guide slot and the second guide slot. A plurality of first terminals received in the first receiving slots. Each of the first terminal has a first connecting portion and the first connecting portion extends forwards to form a first contacting portion passing through the first guide slot and exposed in the corresponding card slot. A plurality of second terminals received in the second receiving slots. Each of the second terminal has a second connecting portion, and the second connecting portion extends forwards to form a second contacting portion passing through the second guide slot and exposed in the corresponding card slot. The second connecting portion of the second terminal extends laterally to form at least one extending portion, and the extending portion enters the first receiving slot and arranged in a back-forward manner relative to the corresponding part of the first terminal. The insulating body has a gap defined between the extending portion and the adjacent extending portion.

Further, each of the second terminal has two extending portions.

Additionally, the first receiving slot passes through a bottom surface of the insulating body.

Furthermore, the first terminal has a first retaining portion retained on the insulating body.

Furthermore, the second terminal has two second retaining portions retained on the insulating body.

Furthermore, the second receiving slot is disposed with a stop block which locates between the two second guide slots.

As compared with the related art, in the electrical connector of the present invention, the first connecting portion of the first terminal is received in the first receiving slot. The second connecting portion of the second terminal extends laterally to form the extending portion and the extending portion enters into the first receiving slot. The extending portion of the second terminal and the first connecting portion of the first terminal are disposed in a front-rear manner. No other slot needs to be additionally formed at the rear end of the insulating body corresponding to the second extending portion of the second terminal, but a distance sufficient to form a partition wall exists at the extending portion formed by the second connecting portion of the second terminal extending laterally, or the thickness of a part of the wall between the adjacent first receiving slots at the rear end of the insulating body is increased, so as to ensure good mechanical performance and electrical performance of the insulating body and meet quality requirements of the electrical connector product. The situation that the wall cannot be disposed at the rear end or the insulating body easy to be broken or damaged due to the thin wall is avoided. As no other slot needs to be additionally formed at the rear end of the insulating body corresponding to the extending portion of the second terminal, the number of the slots of the insulating body is reduced, which is beneficial to the molding of the insulating body, so the production efficiency during the molding of the insulating body is improved.

In order to make the objectives, shape, structure, features and effects of the present invention more comprehensible, the present invention is described in detail below through embodiments with reference to the accompanying drawings.

DETAILED DESCRIPTION OF THE INVENTION

Figure 1:
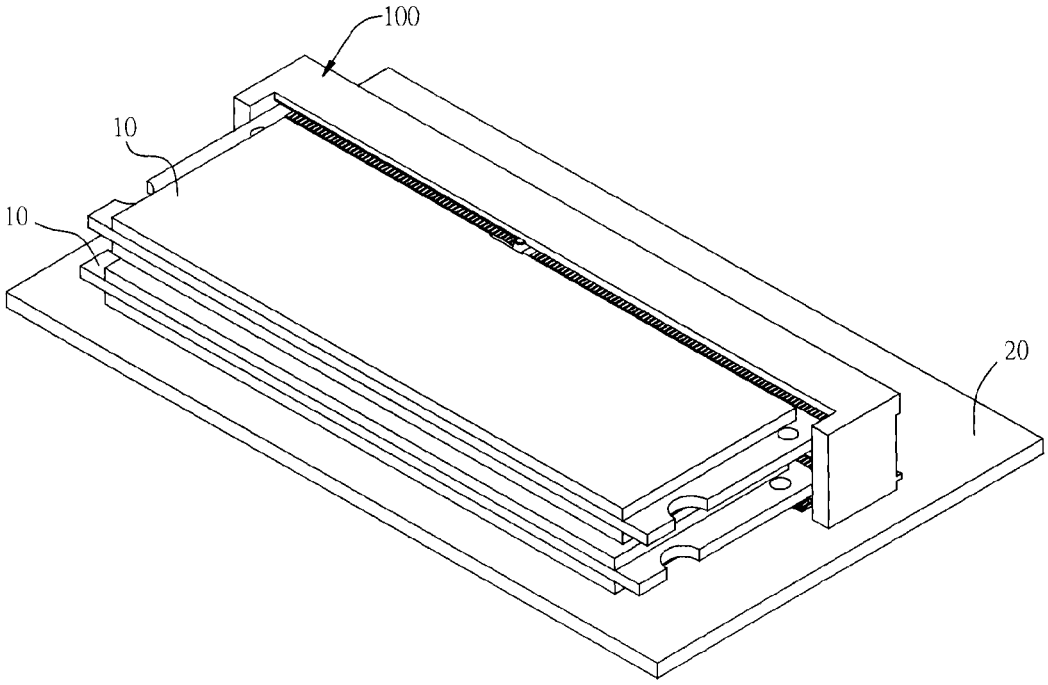
FIG. 1 is a schematic perspective view of an electrical connector electrically connected to two electronic cards and a circuit board according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, FIGS. 1-8, like numbers, if any, indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention. Additionally, some terms used in this specification are more specifically defined below.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and in no way limits the scope and meaning of the invention or of any exemplified term. Likewise, the invention is not limited to various embodiments given in this specification.

Unless otherwise defined, all technical and scientific terms used herein have the same meaning as commonly understood by one of ordinary skill in the art to which this invention pertains. In the case of conflict, the present document, including definitions will control.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, "plurality" means two or more.

As used herein, the terms "comprising," "including," "carrying," "having," "containing," "involving," and the like are to be understood to be open-ended, i.e., to mean including but not limited to.

Figure 2:
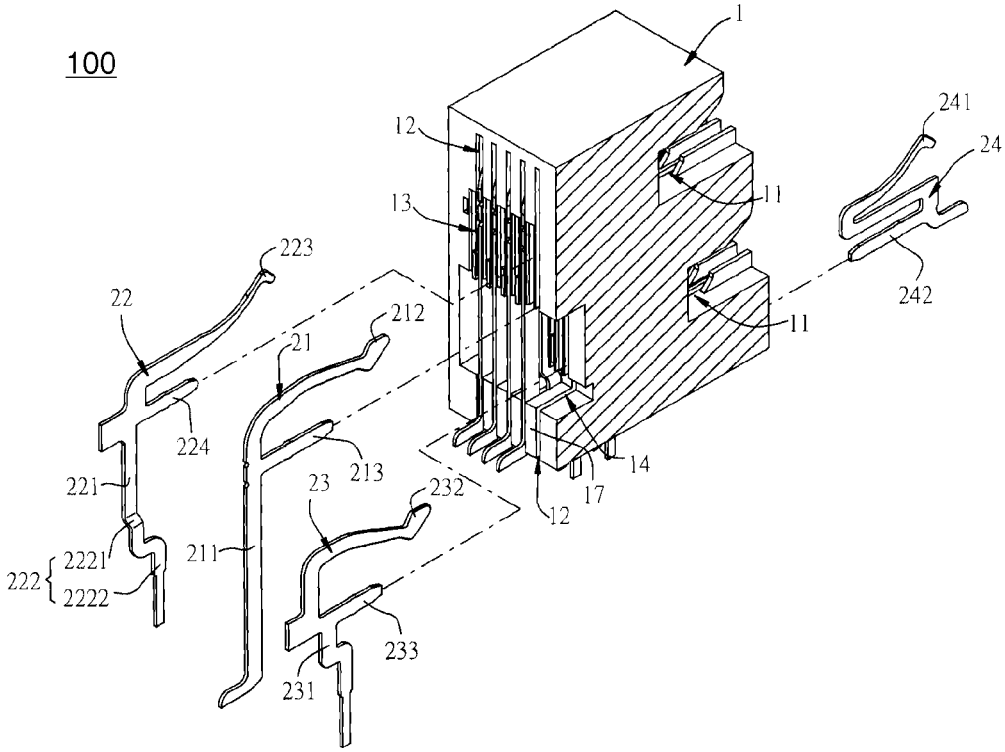
FIG. 2 is a perspective view of the electrical connector according to one embodiment of the present invention.
Figure 3:
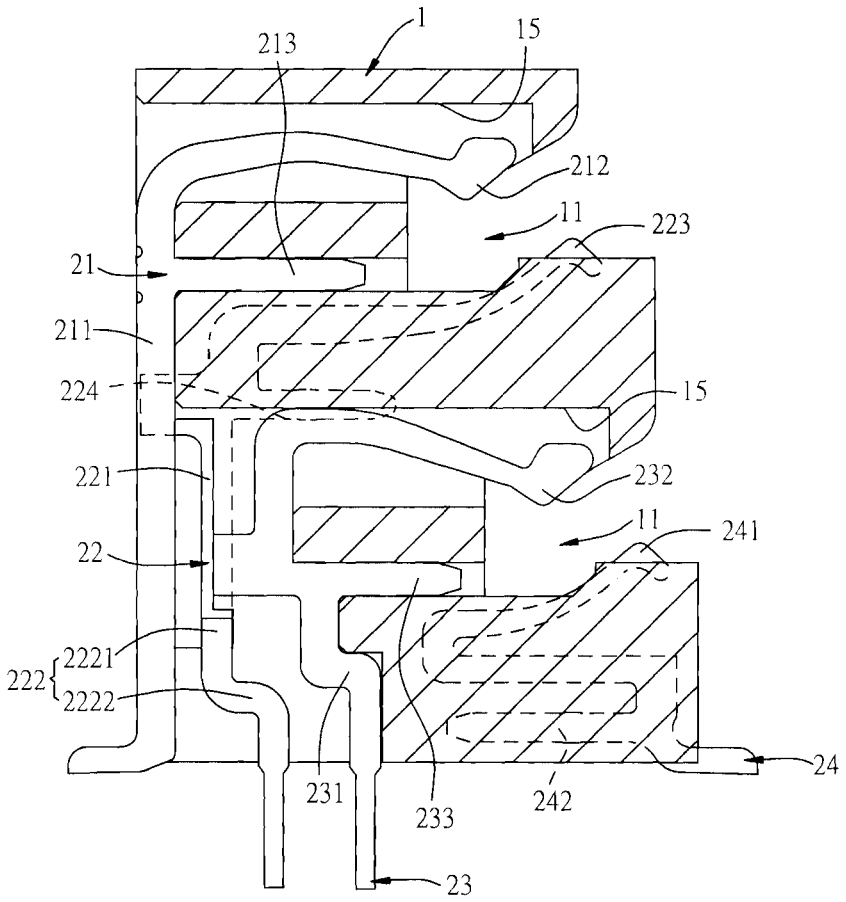
FIG. 3 is a cross-sectional view of the electrical connector along a first receiving slot according to the embodiment of the present invention.
Figure 4:
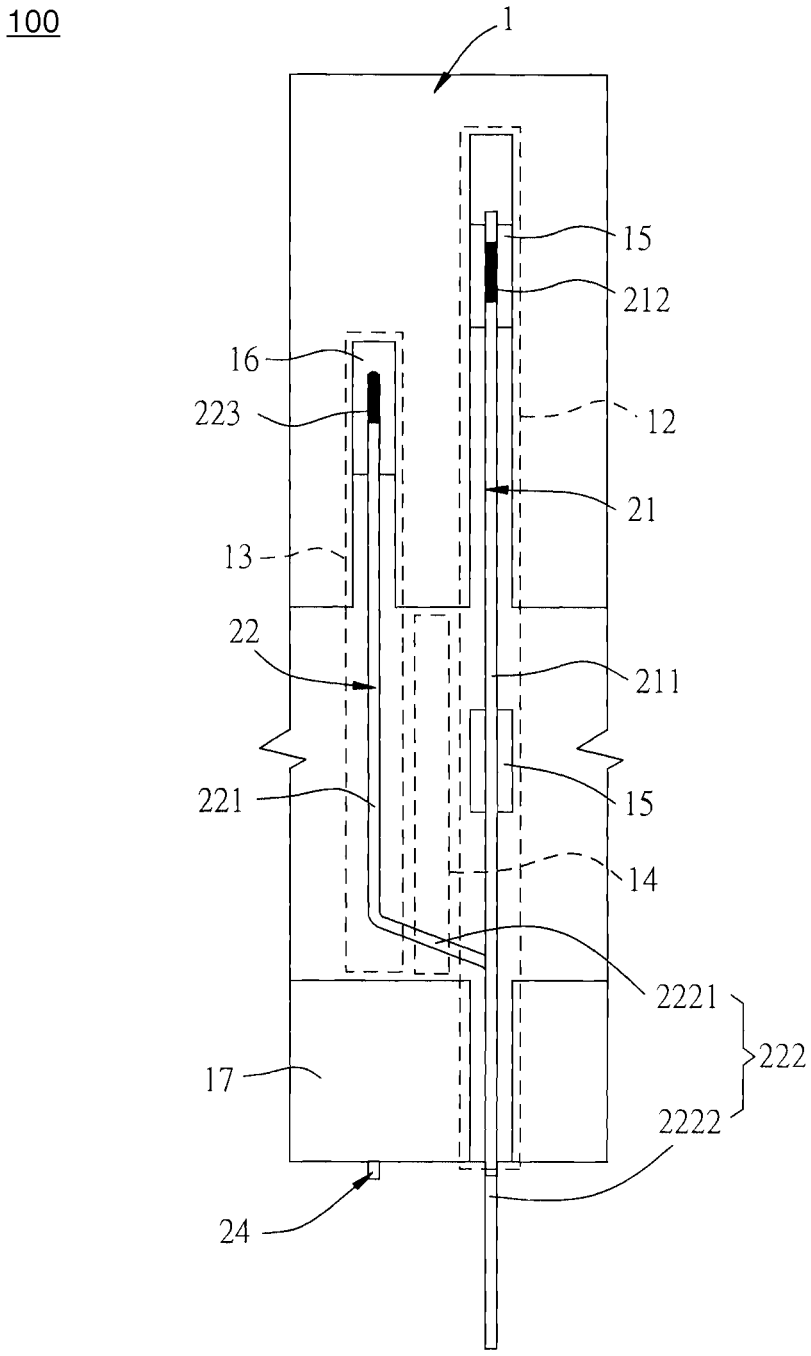
FIG. 4 is another cross-sectional view of the electrical connector from a different angle according to the embodiment of the present invention.

FIGS. 2-4 show a first embodiment of an electrical connector 100 of the present invention. The electrical connector 100 is used for receiving two electronic cards 10 and electrically connecting the electronic cards 10 to a circuit board 20 (as shown in FIG. 1). The electrical connector 100 includes an insulating body 1 and a plurality of first terminals 21, second terminals 22, third terminals 23 and fourth terminals 24 retained in the insulating body 1.

The insulating body 1 has two card slots 11 recessed at a front end thereof for receiving front edges of the electronic cards 10, respectively. The two card slots 11 are arranged in an upper-lower manner. In other embodiments, the number of the card slot 11 may also be one. Electrical contacts disposed on the front edges of the electronic cards 10 electrically contact the corresponding conductive terminals of the electrical connector 100, so as to achieve electrical conduction between the two electronic cards 10 and the circuit board 20.

Adjacent multiple first receiving slots 12 and multiple second receiving slots 13 are disposed at a rear end of the card slots 11 of the insulating body 1. The multiple first receiving slots 12 and the multiple second receiving slots 13 are disposed at an interval. Each of the first receiving slots 12 and each of the second receiving slots 13 are in communication through a through slot 14 disposed therebetween. In this embodiment, the multiple through slots 14 are in communication with each other. In other embodiments, the multiple through slots 14 may not be in communication with each other, and the number of the through slot 14 may also be one. The through slots 14 connect the first receiving slots 12 and the second receiving slots 13.

Each of the first receiving slots 12 extends forwards to form two first guide slots 15. Each of the second receiving slots 13 extends forwards to form a second guide slot 16. The first guide slots 15 and the second guide slots 16 are in communication with the card slots 11 respectively.

The first terminals 21 are correspondingly received in the first receiving slots 12. Each of the first terminal 21 has a first connecting portion 211. The first connecting portion 211 extends forwards to form a first contacting portion 212 passing through one of the first guide slots 15 and exposed in the card slot 11. The first terminal 21 has a first retaining portion 213 extending forwards from the first connecting portion 211 and entering a first retaining slot correspondingly formed and opened on the insulating body 1, so that the first terminal 21 is firmly retained in the insulating body 1. The first retaining portion 213 is located below the first contacting portion 212.

The second terminals 22 are correspondingly received in the second receiving slots 13. Each of the second terminal 22 has a second connecting portion 221. The second connecting portion 221 extends forwards to form a second contacting portion 223 passing through one of the second guide slots 16 and exposed in the card slot 11. The second terminal 22 has a second retaining portion 224 extending forwards from the second connecting portion 221 and entering a second retaining slot correspondingly formed and opened on the insulating body 1, so that the second terminal 22 is firmly retained in the insulating body 1. The second retaining portion 224 is located below the second contacting portion 223.

The second terminal 22 has an extending portion 222 extends laterally from the second connecting portion 221. The extending portion 222 enters the first receiving slot 12 via the through slot 14. The extending portion 222 of the second terminal 22 and the corresponding part of the first terminal 21 are arranged in a front-rear manner.

The extending portion 222 has a turning portion 2221 and a connecting section 2222. The turning portion 2221 connects with the second connecting portion 221 via the through slot 14. The connecting section 2222 and the corresponding part of the first connecting portion 211 of the first terminal are arranged in the first receiving slot 12 in a front-rear manner.

Even if the connecting section 2222 of the extending portion 222 and the corresponding part of the first connecting portion 211 of the first terminal 21 are a bit offset from each other but substantially formed in front-rear manner, as long as enough space is provided between the extending portion 222 and the adjacent extending portion to form a partition wall, the object of the invention can also be achieved.

The first receiving slot 12 runs through a bottom of the insulating body 1. The second receiving slot 13 does not run through the bottom of the insulating body 1. An end of the second receiving slot 13 are substantially at the same height level with tail ends of the extending section 222 at a lower position of the second terminal 22. The insulating body 1 forms a partition wall 17 between the extending portion 222 and an adjacent extending portion 222. No other slot needs to be additionally formed at the rear end of the insulating body 1 corresponding to the second connecting section 2222 of the second terminal 22, instead, the partition wall 17 is formed at a position where the second connecting portion 221 of each of the second terminals 22 extends laterally to form the extending portion 222.

The third terminals 23 are received in the first receiving slots 12. Each of the third terminals 23 has a third connecting portion 231. A corresponding part of the third connecting portion 231 and the connecting section 2222 of the extending portion 222 of the second terminal 22 are disposed in the first receiving slot 12 in a front-rear manner. Each of the third terminals 23 extends forwards from the third connecting portion 231 to form a third contacting portion 232 passing through one of the first guide slots 15 and exposed in the corresponding card slot 11. The third terminal 23 has a third retaining portion 233 extending forwards from the third connecting portion 231 and entering a third retaining slot correspondingly formed on the insulating body 1, so that the third terminal 23 is firmly retained in the insulating body 1. The third retaining portion 233 is located below the third contacting portion 232.

The fourth terminals 24 are inserted from the front end of the insulating body 1, and each of the fourth terminals 24 has a fourth contacting portion 241 exposed in the corresponding card slot 11. The fourth terminal 24 has a fourth retaining portion 242 extending downwards from the fourth contacting portion 241 and entering a fourth retaining slot correspondingly formed and opened on the insulating body 1, so that the fourth terminal 24 is firmly retained in the insulating body 1.

During assembly, referring to FIGS. 2-4, first, the third terminals 23 are correspondingly installed from the rear end of the insulating body 1, so that the third connecting portions 231 of the third terminals 23 are correspondingly received in the first receiving slots 12. Then the second terminals 22 are correspondingly installed from the rear end of the insulating body 1, so that the second connecting portions 221 of the second terminals 22 are correspondingly received in the second receiving slots 13. Each of the extending portions 222 enters the first receiving slot 12 via the through slot 14, and the connecting section 2222 and corresponding part of the third connecting portion 231 are disposed in the first receiving slot 12 in a front-rear manner. The second contacting portions 223 pass through the second guide slots 16 and are exposed in the two card slots 11.

After that, the first terminals 21 are correspondingly installed from the rear end of the insulating body 1, so that the first connecting portions 211 of the first terminals 21 are correspondingly received in the multiple first receiving slots 12. Corresponding parts of the first connecting portions 211 and the connecting sections 2222 are disposed in the first receiving slots in a front-rear manner. The first contacting portions 212 pass through the first guide slots 15 and are exposed in the card slots 11. Finally, the multiple fourth terminals 24 are correspondingly installed from the front end of the insulating body 1, so that the fourth contacting portion 241 of each of the fourth terminals 24 is exposed in the corresponding card slot 11.

In the first embodiment, as the first connecting portion 211 of the first terminal 21 is received in the first receiving slot 12, the extending portion 222 is extended laterally from the second connecting portion 221 of the second terminal 22, and the extending portion 222 enters the first receiving slot 12 via the through slot 14, the connecting section 2222 of the extending portion 222 and the corresponding part of the first connecting portion 211 are located in the first receiving slot 12 in front-rear manner.

No other slot needs to be additionally formed at the rear end of the insulating body 1 corresponding to the connecting section 2222 of the extending portion 222 of the second terminal 22, instead, the partition wall 17 is formed at a position where the second connecting portion 221 of the second terminal 22 extends laterally to form the extending section 222, so that the thickness of a part of the wall between the adjacent first receiving slots 12 at the rear end of the insulating body 1 is increased. During assembling, the wall at the rear end of the insulating body 1 easy to be deformed or broken is avoided, thus ensuring good mechanical performance and electrical performance of the insulating body 1 and meeting the quality requirements of the electrical connector 100.

Figure 5:
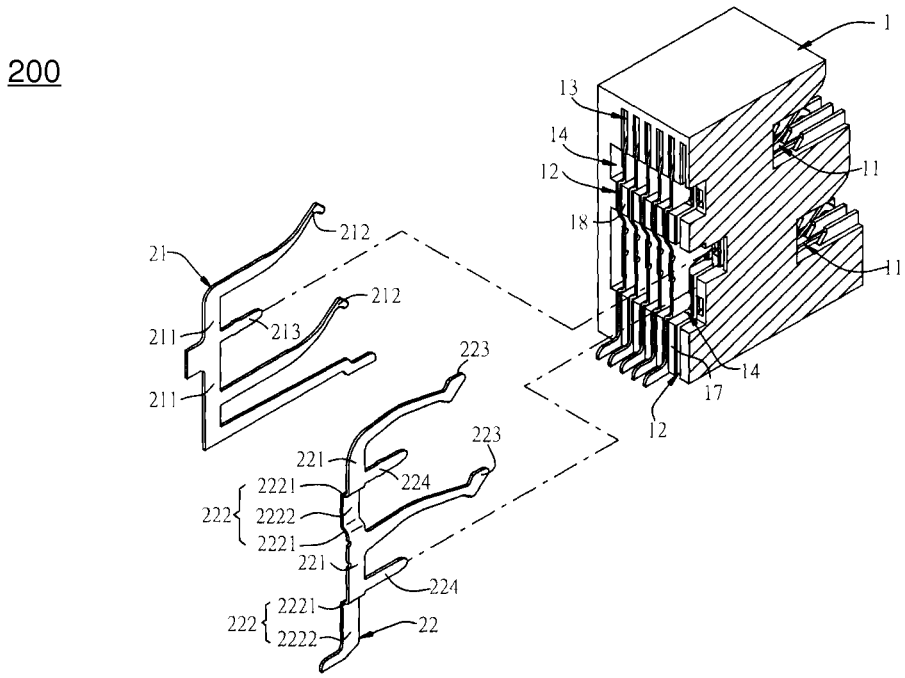
FIG. 5 is a perspective view of an electrical connector according to another embodiment of the present invention.
Figure 6:
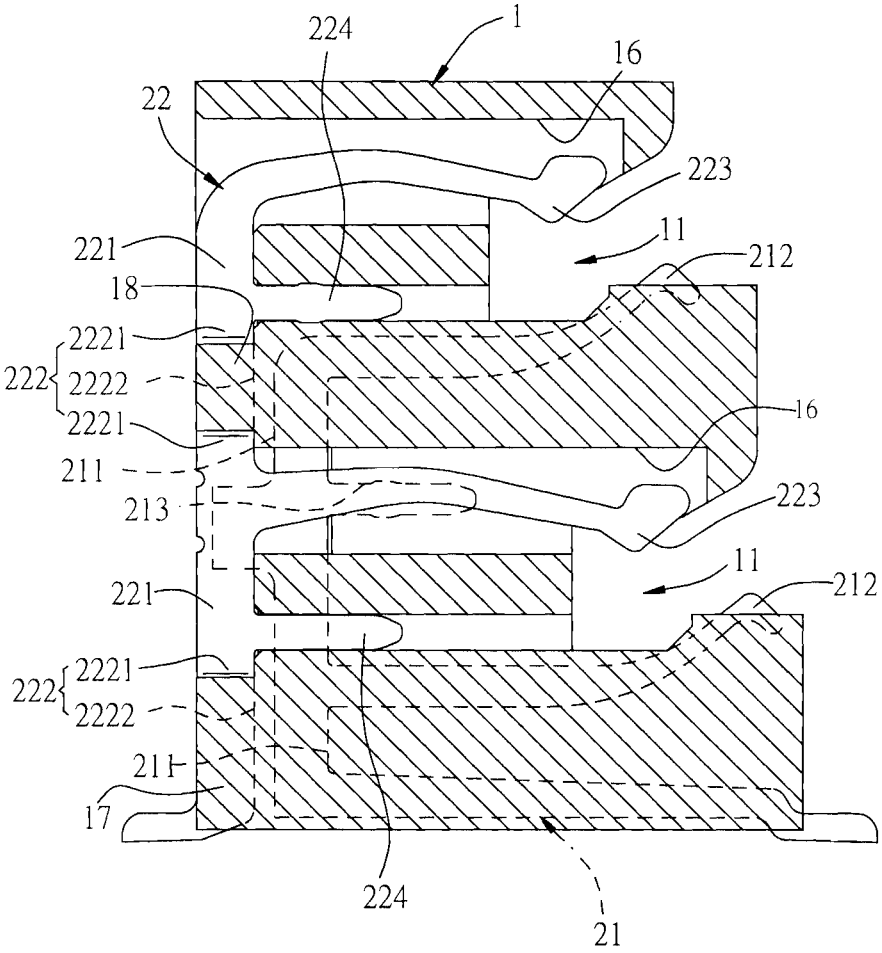
FIG. 6 is a cross-sectional view of the electrical connector along a second receiving slot according to the embodiment of the present invention.
Figure 7:
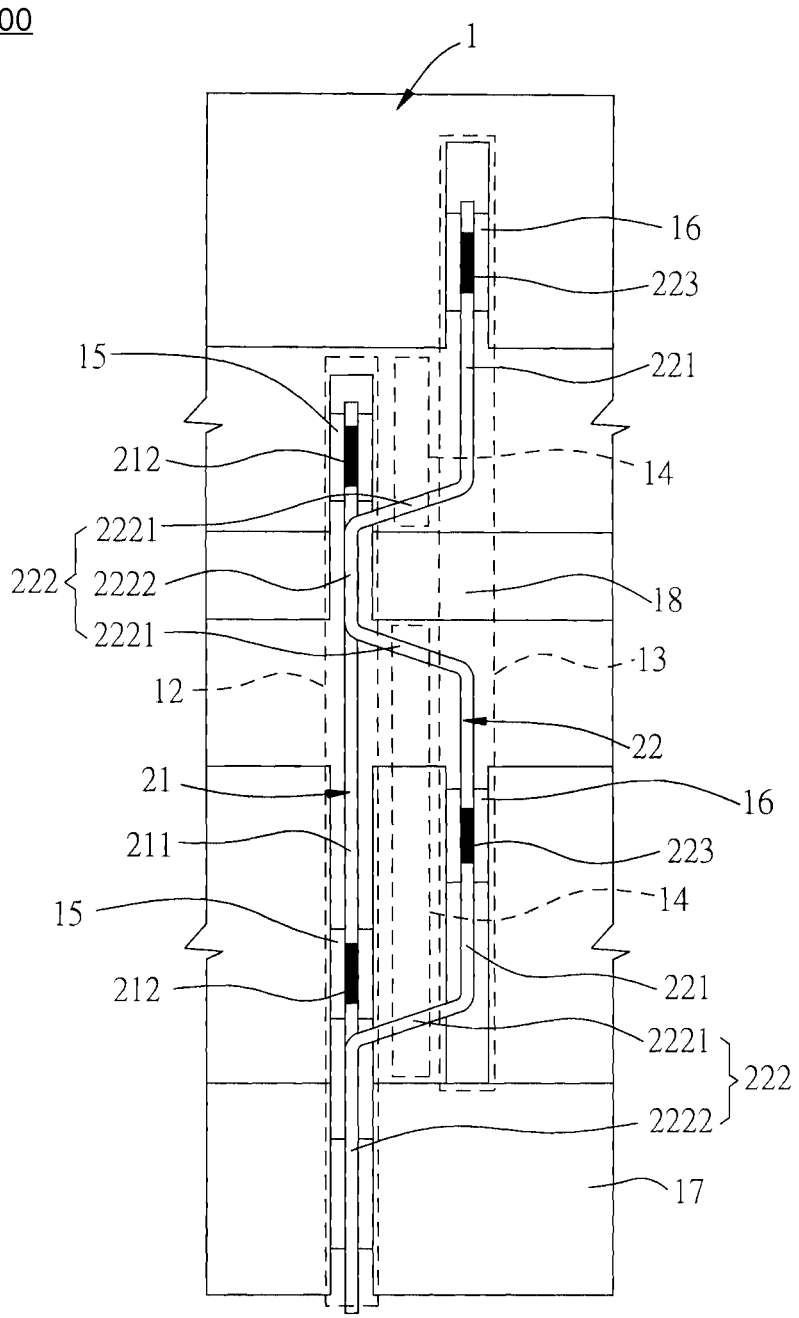
FIG. 7 is a cross-sectional view of the electrical connector from a different angle according to the embodiment of the present invention.

FIGS. 5-7 show the second embodiment of the electrical connector 200 of the present invention. The difference of the second embodiment from the first embodiment is that two through slots 14 are defined between each of the first receiving slots 12 and the corresponding second receiving slot 13, and the through slots 14 on the same plane communicate with each other. Each of the first receiving slots 12 extends forwards to form two first guide slots 15. Each of the second receiving slots 13 extends forwards to form two second guide slots 16. Each of the card slots 11 communicate with one of the first guide slots 15 and one of the second guide slots 16, respectively. The first terminal 21 includes two connecting portions 211. Each of the connecting portions 211 extends forwards to form the first contacting portion 212 passing through the first guide slot 15 and exposed in the card slot 11. A stop block 18 is defined in each of the second receiving slots 13 and located between two second guide slots 16.

The second terminal 22 has two second connecting portions 221 and two extending portions 222 extending laterally from the second connecting portions 221, passing through the through slots 14 and entering the first receiving slot 12. Each of the extending portions 222 includes the connecting section 2222. The connecting section 2222 and the corresponding part of the first connecting portion 211 of the first terminal 21 are located in the first receiving slot 12 in a front-rear manner. The second terminal 22 has three turning portions 2221 connecting with the two second connecting portions 221 and the two connecting sections 2222 via the through slots 14. The second terminal 22 includes the second contacting portions 223 extending forwards from each of the two second connecting portions 221, passing through the second guide slot 16 and exposed in the card slot 11. That is, the number of the contacting portions 223 is two. The second terminal 22 has a second retaining portion 224 extending forwards from each of the two second connecting portions 221. Each of the second retaining portions 224 enters one of two second retaining slots so as to make the second terminal 22 secured in the insulating body 1.

No other slot needs to be additionally formed at the rear end of the insulating body 1 corresponding to the connecting section 2222 of the extending portion 222 of the second terminal 22, instead, a partition wall 17 and a stop block 18 are formed at a position where the second connecting portion 221 of the second terminal 22 extends laterally to form the extending section 222, so that the thickness of part of the wall between the adjacent first receiving slots 12 at the rear end of the insulating body 1 is increased. During assembling, the wall at the rear end of the insulating body 1 easy to be deformed or broken is avoided, thus ensuring good mechanical performance and electrical performance of the insulating body 1 and meeting the quality requirements of the electrical connector.

In the second embodiment, the electrical connector 200 is respectively conducted with the electrical contacts at the front edges of two electronic cards 10 merely through two first contacting portions 212 of the first terminal 21 and two second contacting portions 223 of the second terminal 22, so as to achieve electrical conduction between the two electronic cards 10 and the circuit board 20, but does not include the third terminal 23 and the fourth terminal 24 in the first embodiment. As the first connecting portion 211 of the first terminal 21 is received in the first receiving slot 12, the second extending portion 221 of the second terminal 22 is received in the first receiving slot 12, and the connecting section 2222 and the first connecting portion 211 are disposed in the first receiving slot in a front-rear manner, the objectives of the first embodiment can also be achieved in the implementation process.

Figure 8:
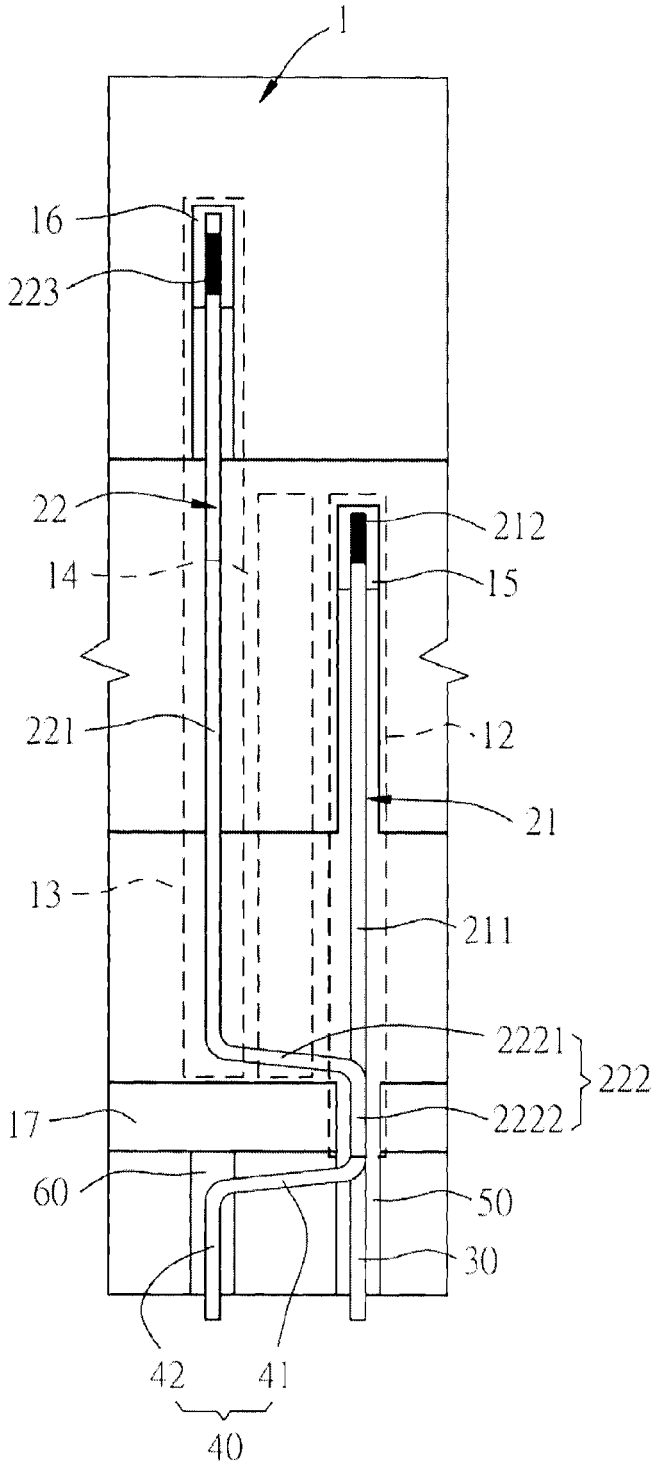
FIG. 8 is a cross-sectional view of the electrical connector according to yet another embodiment of the present invention.

In the third embodiment, referring to FIG. 8, the first terminal 21 extends downwards from the first connecting portion 211 to form a base portion 30. The second terminal 22 extends laterally from the second connecting portion 221 to form the extending section 222. Meanwhile, the second terminal 22 extends laterally from the extending portion 222 to form a tail portion 40. The tail portion 40 has a bending portion 41 connecting with the extending portion 222 and a positioning portion 42. The insulating body 1 has multiple first accommodating holes 50 and multiple second accommodating holes 60 formed and opened corresponding to the base portions 30 and the positioning portions 42 of the tail portions 40, respectively. The first accommodating holes 50 and the first receiving slots 12 are in communication, so that the second terminals 22 can be firmly retained in the insulating body 1, and the effect of the foregoing embodiment can be achieved.

Based on the above, among other things, the electrical connector of the present invention has the following beneficial effects.

1. In the present invention, as the first connecting portion of the first terminal is received in the first receiving slot, the second connecting portion of the second terminal extends laterally to form the extending portion, the extending portion enters the first receiving slot via the through slot, the connecting section of the extending portion are received in the first receiving slot, the connecting section and the first connecting portion are arranged in the first receiving slot in a front-rear manner. No other slot needs to be additionally opened at the rear end of the insulating body corresponding to the second connecting section of the second terminal, instead, the partition wall (or the stop block) is formed at the position where the second connecting portion of the second terminal extends laterally to form the extending portion. That is, the space for extension of a part of the wall of the first receiving slot is enlarged, so that a part of the rear end of the insulating body between adjacent first receiving slots has a sufficient space for disposing the wall, or the thickness of the wall is increased, so as to ensure good mechanical performance and electrical performance of the insulating body and meet the quality requirements of the electrical connector product. The situation that the wall cannot be disposed at the rear end or the insulating body easy to be broken or damaged due to the thin wall is avoided.

2. In the present invention, as the first connecting portion of the first terminal is received in the first receiving slot, the second connecting portion of the second terminal extends laterally to form the extending portion, and entering the first receiving slot. The connection section of the extending portion is received in the first receiving slot and the connecting section and the first connecting portion are arranged in the first receiving slot in a front-rear manner. As no other slot needs to be additionally formed and opened at the rear end of the insulating body corresponding to the connecting section of the second terminal, the number of the slots of the insulating body is reduced, which is beneficial to the molding of the insulating body, so the production efficiency during the molding of the insulating body is improved.

3. In the present invention, as the insulating body is integrally formed, and the two card slots are recessed at the front end of the insulating body for inserting the two electronic cards, the two electronic cards are electrically connected to the circuit board through the electrical connector in a stacked manner at the same time, so that the layout and the space of the circuit board are utilized effectively, which reduces the production cost, and meets the requirements for miniaturization of the electrical connector product.

While there has been shown several and alternate embodiments of the present invention, it is to be understood that certain changes can be made as would be known to one skilled in the art without departing from the underlying scope of the present invention as is discussed and set forth above and below including claims. Furthermore, the embodiments described above and claims set forth below are only intended to illustrate the principles of the present invention and are not intended to limit the scope of the present invention to the disclosed elements.

What is claimed is:

1. An electrical connector, comprising:

(a) an insulating body, having at least one card slot recessed at a front end thereof, a plurality of adjacent first receiving slots and second receiving slots disposed at a rear end of the insulating body, wherein each of the first receiving slots and the second receiving slots extends forwards to form a first guide slot and a second guide slot respectively, and the first and the second guide slots are in communication with the card slot;

(b) a plurality of first terminals received in the first receiving slots, wherein each of the first terminals has a first connecting portion, the first connecting portion extends forwards to form a first contacting portion passing through the first guide slot and exposed in the card slot; and (c) a plurality of second terminals received in the second receiving slots, wherein each of the second terminals has a second connecting portion, the second connecting portion extends forwards to form a second contacting portion passing through the second guide slot and exposed in the card slot, wherein each of the second terminals has an extending portion extending laterally from the second connecting portion, and the extending portion enters into the first receiving slot and is arranged in a front-rear manner relative to a corresponding part of the first connecting portion of the first terminal; and wherein the insulating body has a gap defined between the extending portion and an adjacent extending portion.

2. The electrical connector according to claim 1, further comprising a plurality of third terminals, wherein each of the third terminals has a third connecting portion, and the third connecting portion and the extending portion of each of the second terminals are arranged in a front-rear manner in the first receiving slot.

3. The electrical connector according to claim 2, wherein each of the third terminals extends forwards from the third connecting portion to form a third contacting portion passing through one of the first guide slots and exposed in a corresponding card slot.

4. The electrical connector according to claim 1, further comprising a plurality of fourth terminals, wherein each of the fourth terminals is inserted from the front of the insulating body and has a fourth contacting portion exposed in a corresponding card slot.

5. An electrical connector, comprising:

(a) an insulating body, having two card slots recessed at a front end thereof and arranged in an upper-lower manner, wherein the insulating body has a plurality of adjacent first receiving slots and second receiving slots disposed at a rear end of the insulating body, each of the first receiving slots and the second receiving slots extend forwards respectively to form a first guide slot and a second guide slot arranged in an upper-lower manner, each of the card slots is in communication with the first guide slot and the second guide slot;

(b) a plurality of first terminals received in the first receiving slots, wherein each of the first terminal has a first connecting portion, the first connecting portion extends forwards to form a first contacting portion passing through the first guide slot and exposed in a corresponding card slot; and (c) a plurality of second terminals received in the second receiving slots, wherein each of the second terminal has a second connecting portion, the second connecting portion extends forwards to form a second contacting portion passing through the second guide slot and exposed in the corresponding card slot, wherein each of the second terminals has at least an extending portion laterally from the second connecting portion, and the extending portion enters into the first receiving slot and is arranged in a rear-front manner relative to a corresponding part of the first connecting portion of the first terminal; and wherein the insulating body has a gap defined between the extending portion and an adjacent extending portion.

6. The electrical connector according to claim 5, wherein each of the second terminals has two extending portions.

7. The electrical connector according to claim 5, wherein each of the first receiving slots runs through a bottom of the insulating body.

8. The electrical connector according to claim 5, wherein each of the first terminals has a first retaining portion retained on the insulating body.

9. The electrical connector according to claim 5, wherein each of the second terminals has two second retaining portions retained on the insulating body.

10. The electrical connector according to claim 5, wherein a stop block is disposed in each of the second receiving slots and located between two second guide slots.

* * * * *